US006851205B2

(12) United States Patent
Chen et al.

(10) Patent No.: US 6,851,205 B2
(45) Date of Patent: Feb. 8, 2005

(54) SHOE HAVING A CUP MEMBER CONNECTED TO THE BOTTOM OF A WATERPROOF BREATHABLE LINING

(75) Inventors: Eddie Chen, 9F, No. 201, Sec. 1, Taichung-Kang Rd., Taichung City (TW); Melissa Wang, Taichung (TW)

(73) Assignee: Eddie Chen, Taichung (TW)

( * ) Notice: Subject to any disclaimer, the term of this patent is extended or adjusted under 35 U.S.C. 154(b) by 0 days.

(21) Appl. No.: 10/354,342

(22) Filed: Jan. 29, 2003

(65) Prior Publication Data

US 2004/0143996 A1 Jul. 29, 2004

(51) Int. Cl.[7] ..... A43B 23/07
(52) U.S. Cl. ..... 36/55; 36/14
(58) Field of Search ..... 36/55, 14, 12, 36/10

(56) References Cited

U.S. PATENT DOCUMENTS 4,599,810 A 7/1986 Sacre ..... 36/55
4,706,316 A * 11/1987 Tanzi ..... 36/55
5,743,027 A * 4/1998 Barma ..... 36/4
6,065,227 A * 5/2000 Chen ..... 36/4
6,412,193 B1 7/2002 Chen ..... 36/14
6,446,360 B1 * 9/2002 Sheets et al. ..... 36/55
6,474,002 B2 * 11/2002 Chen ..... 36/55
2003/0167656 A1 * 9/2003 Tung ..... 36/55

* cited by examiner

*Primary Examiner*—Ted Kavanaugh
(74) *Attorney, Agent, or Firm*—Ladas & Parry LLP

(57) ABSTRACT

A waterproof shoe includes a waterproof breathable lining sleeve which is mounted inside an upper and which is made of an air-permeable waterproof material, and a cup member attached to a bottom end of the lining sleeve. The cup member is made of an air-impermeable waterproof material and includes a cup bottom which has a toe region and a heel region, and a cup wall which projects laterally and upwardly from said cup bottom and extends around the toe and heel regions. Preferably, the cup member is a molded body formed by a molding process, and the bottom end of the upper is lasted over the cup bottom.

4 Claims, 11 Drawing Sheets

SHOE HAVING A CUP MEMBER CONNECTED TO THE BOTTOM OF A WATERPROOF BREATHABLE LINING

BACKGROUND OF THE INVENTION

1. Field of the Invention

The invention relates to a waterproof shoe, more particularly to a shoe having a waterproof, breathable lining mounted within an upper.

2. Description of the Related Art

As shown in FIG. 1, a typical waterproof breathable shoe includes an upper 1, an inner liner 2, and a lining 3 made of a waterproof breathable laminate, an insole 4, and an outsole 5 attached to the bottom end of the upper 1. The lining 3 is adhered to the inner liner 2 to form an integral unit before being assembled within the upper 1. In assembly, the top ends of the lining 3 and the inner liner 2 are sewn to the top end of the upper 1. While the waterproof shoe as such can provide a waterproofing effect, since the lining sleeve 3 is bonded to the inner liner 2 by using an adhesive, the breathable characteristics of the lining sleeve 3 can be affected adversely by the adhesive.

FIG. 2 shows a sock-like liner 6 made of a waterproof breathable laminate as disclosed in U.S. Pat. No. 4,599,810. The liner 6 has a bottom closed end extending below an insole which is connected to an upper by a lasting process. The top end of the liner 6 is connected to the top end of the upper. Since the bottom end of the liner 6 need to extend below the insole, it can be damaged by the forces applied to the insole during the lasting process. Although the outer surface of the bottom end of the liner 6 can be protected by adhering a protective tape thereto, the use of the protective tape can increase the production cost thereof. In addition, the mechanical stress produced at the bottom of the shoe can cause the bottom end of the liner 6 to wear after a period of use. Especially, the liner 6 which extends to the toe region of a shoe may be pierced by the toe nails of the wearer's foot.

In order to provide long lasting waterproofness of a waterproof breathable liner, U.S. Pat. No. 5,918,382 suggests a shoe in which a waterproof breathable lining is bonded adhesively to an inner side of an upper and to an outer side of an inner liner. The lower area of the waterproof breathable lining has a border section which is turned back and bonded to the side having a functional layer. While the waterproof breathable lining can withstand the mechanical stress produced by the wearer's foot, the arrangement thereof is complicated. In addition, since the lining extends to the bottom of the upper, a considerable amount of waterproof breathable material is needed to fabricate the lining, thereby increasing the production cost.

SUMMARY OF THE INVENTION

An object of the invention is to provide a waterproof breathable shoe of the above-mentioned type, which is durable and which can be produced in a simple manner.

Another object of the invention is to provide a waterproof breathable shoe including a waterproof breathable lining which does not extend to the bottom of an upper and which can therefore be fabricated at a reduced cost.

Accordingly, a waterproof shoe according to the present invention comprises: an upper; a waterproof breathable lining sleeve mounted inside the upper and having a top end and a bottom end, the lining sleeve being made of an air-permeable waterproof material, and attached to the bottom end of the lining sleeve; and a cup member made of an air-impermeable waterproof material and including a cup bottom which has a toe region and a heel region connected to the toe region, and a cup wall which projects laterally and upwardly from the cup bottom and extends around the toe region and the heel region.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
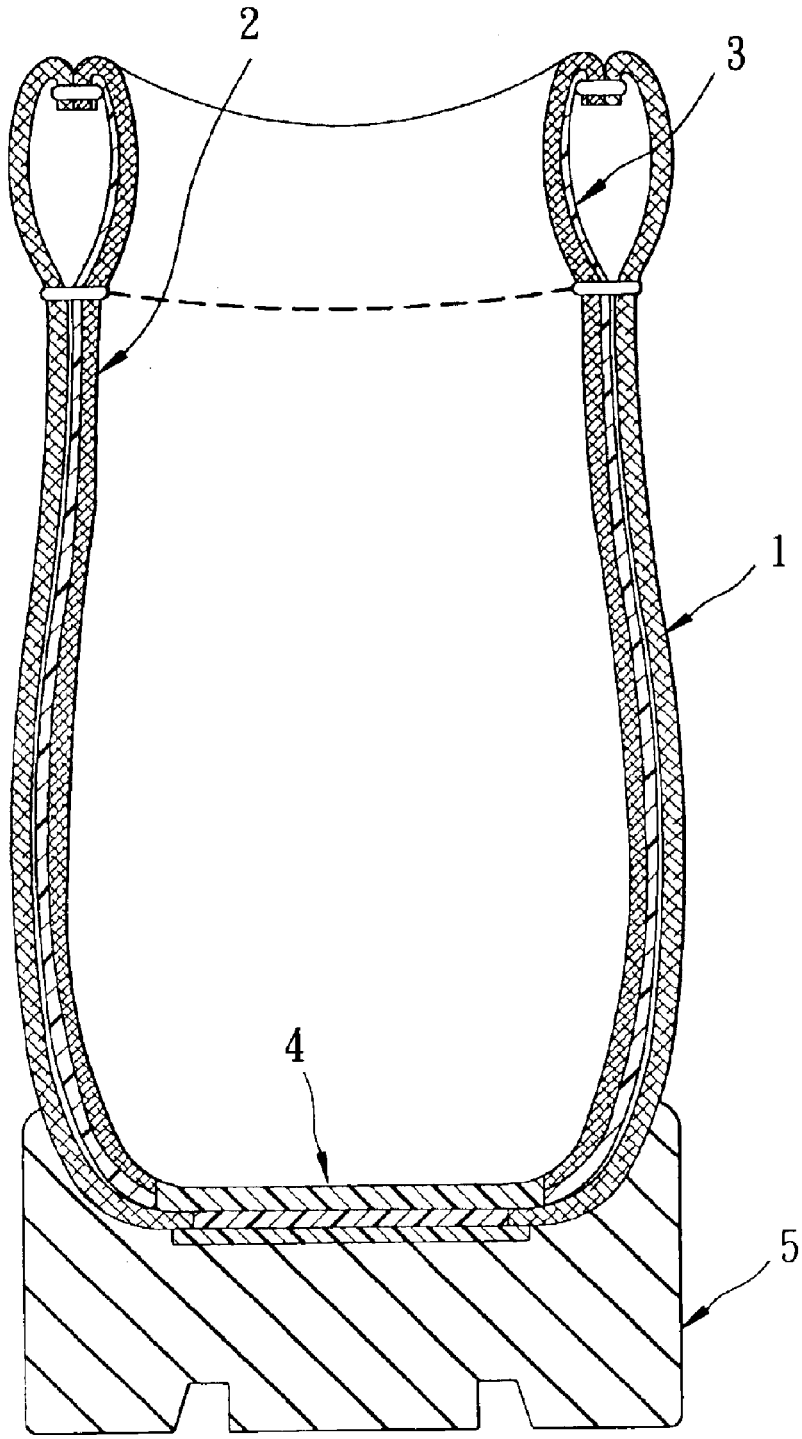
FIG. 1 PRIOR ART
FIG. 1 is a sectional view of a conventional waterproof shoe.
Figure 2:
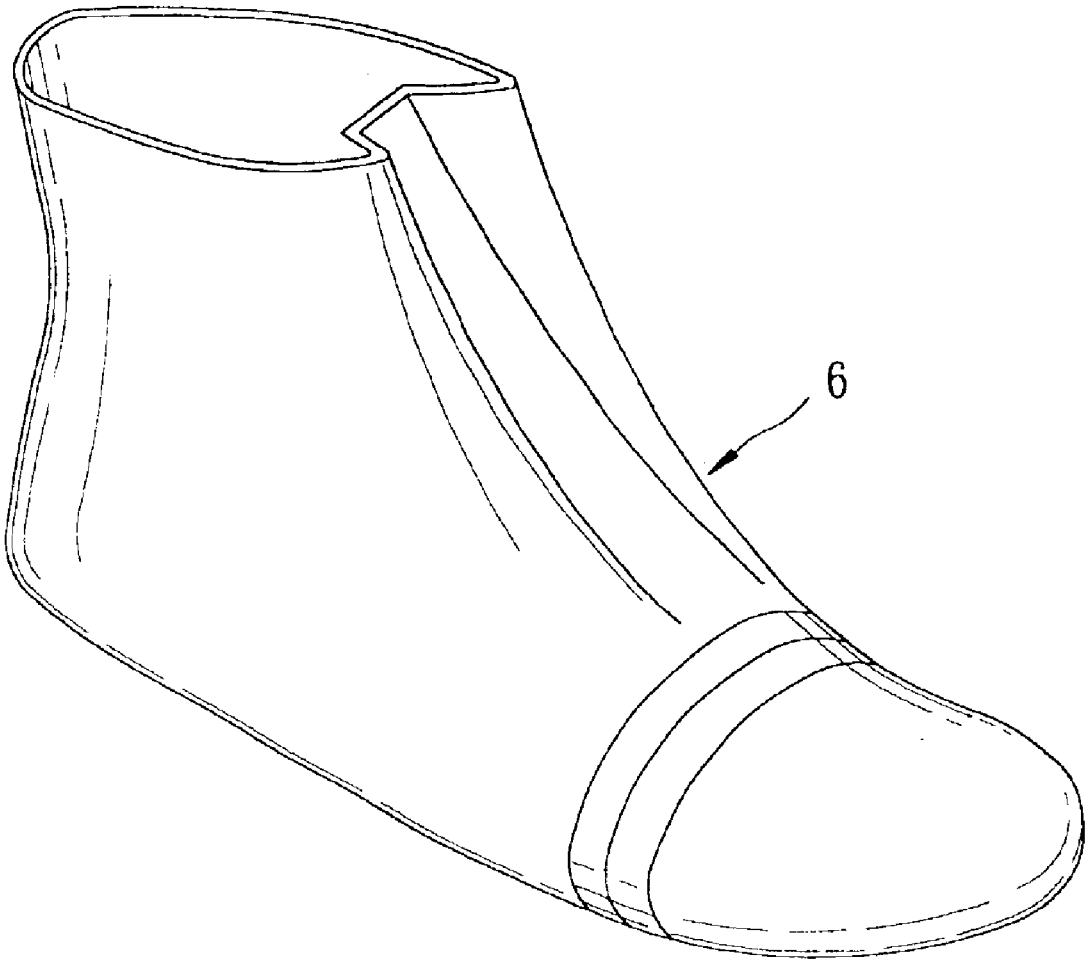
FIG. 2 PRIOR ART
FIG. 2 is a perspective view of a waterproof breathable lining.
Figure 3:
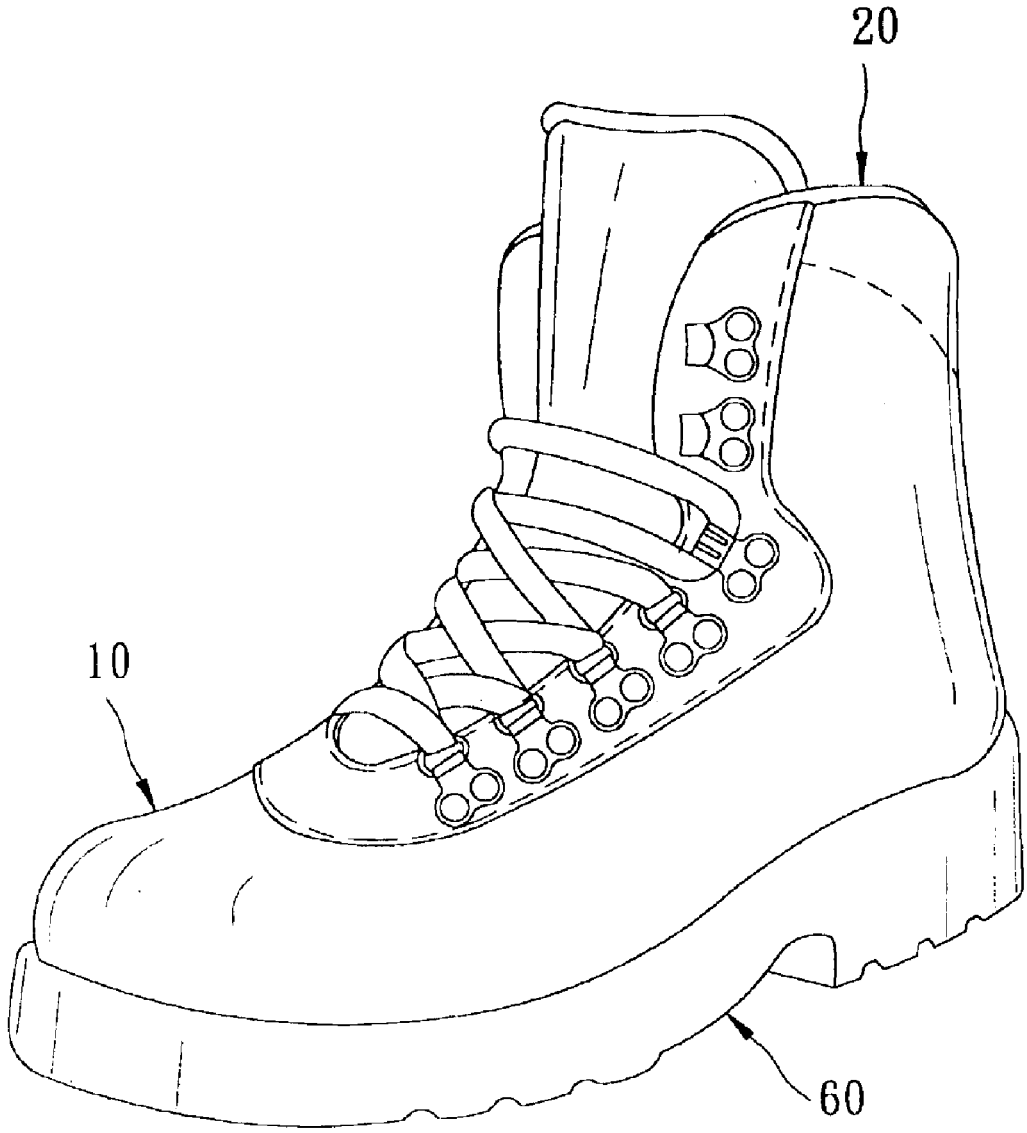
FIG. 3 is a perspective view of a first preferred embodiment of the shoe according to the present invention.
Figure 4:
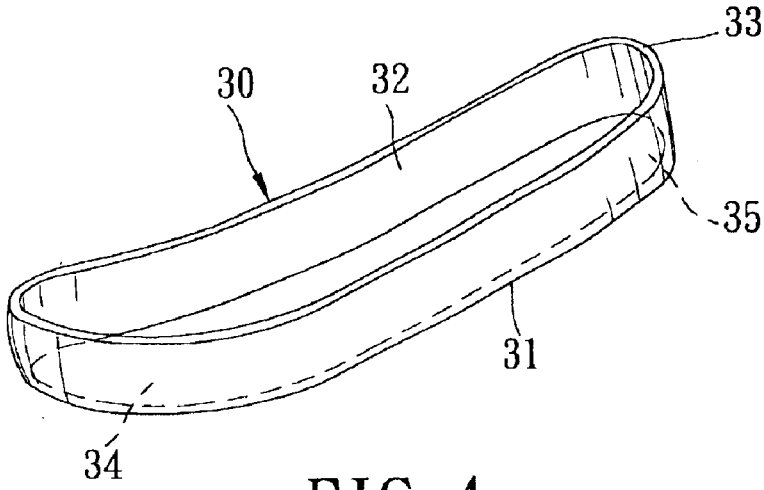
FIG. 4 is a perspective view of a cup member according to the present invention.
Figure 5:
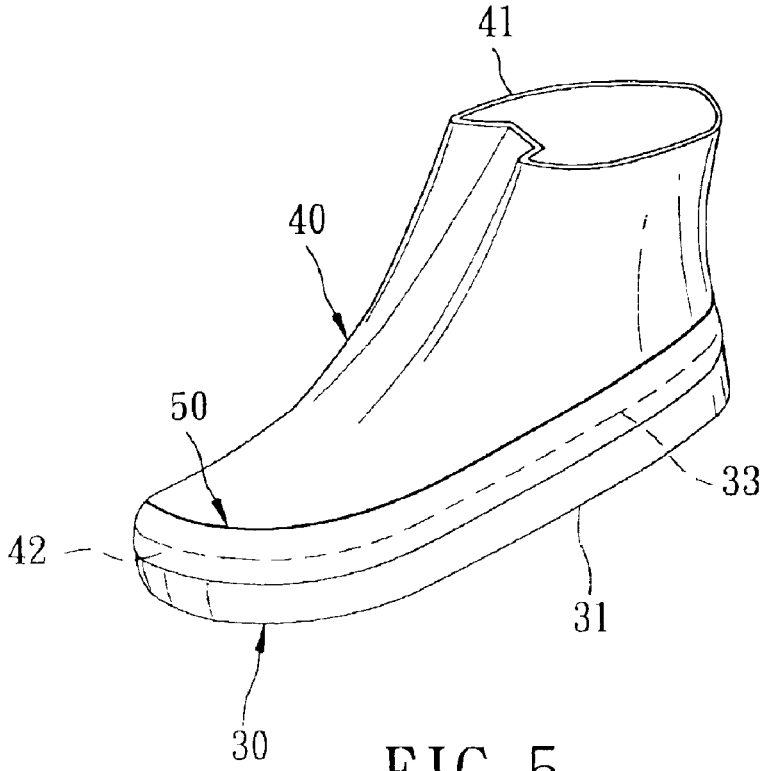
FIG. 5 is a perspective view of a waterproof breathable lining unit according to the present invention.
Figure 6:
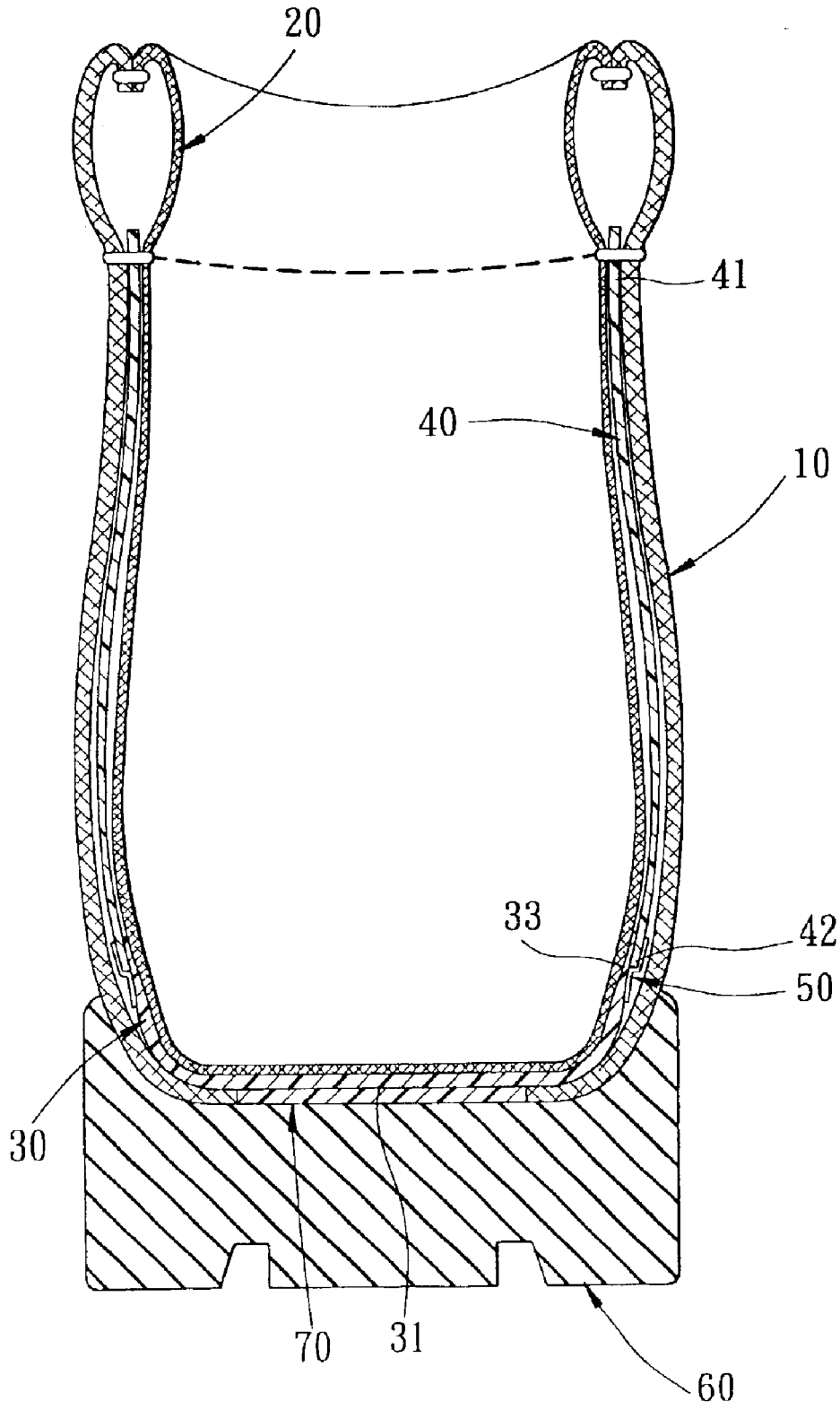
FIG. 6 is a sectional view of the first preferred embodiment of FIG. 3.

The present invention will be illustrated with reference to FIGS. 3 to 12, wherein like elements are represented by like reference numerals.

Referring to FIGS. 3, 4, 5 and 6, the first embodiment of a waterproof shoe according to the present invention is shown to include an upper 10, an inner liner 20, a cup member 30, a waterproof breathable lining sleeve 40, a waterproof sealing member 50, an outsole 60 and a filler layer 70.

The upper 10 is made of leather or a fabric material. The inner liner 20 has a sock-like shape and is disposed inside the upper 10. The top end of the inner liner 20 is sewn to the top end of the upper 10.

The cup member 30 is connected to the bottom end of the upper 10 and is made of a waterproof material. Examples of the materials useful to make the cup member 30 include ethyl vinyl acetate copolymer, polyurethane, polyethylene, polyvinyl chloride, expandable polyethylene, and neoprene rubber. The cup member 30 has a cup bottom 31 and a cup wall 32 which extends laterally and upwardly from the cup bottom 31 and which has an open top end 33. The cup bottom 31 includes a toe region 34 and a heel region 35, and the cup wall 32 extends around the toe region 34 and the heel region 35. The cup member 30 may be fabricated by using any suitable process. In this embodiment, the cup member 30 is a three-dimensional molded body which is produced by using a molding method.

The waterproof breathable lining sleeve 40 is disposed between the inner liner 20 and the upper 10. The lining sleeve 40 is made of a waterproof breathable material having a waterproof, air permeable membrane. An example of such a waterproof, air permeable membrane is a thermoplastic membrane which is well-known under the trademark of Goretex. The lining sleeve 40 has an open top end 41 sewn to the top end of the upper 10 and to the top end of the inner liner 20, and an open bottom end 42 adhered to the cup wall 32 of the cup member 30 in a fluidly sealing manner. In particular, the waterproof sealing member 50 which is in the form of a waterproof sealing tape, is disposed along the bottom end 42 of the lining sleeve 40 and is adhered to the outer surface of the cup wall 32 and the outer surface of the lining sleeve 40. Alternatively, the waterproof sealing member 50 may be a waterproof adhesive attached to the bottom end 42 of the lining sleeve 40 and to the top end 33 of the cup member 30.

In assembly, the top end of the inner liner 20 is first sewn to the top end of the upper 10, and the bottom end 42 of the lining sleeve 40 is adhered to the cup wall 32 of the cup member 30 by means of the waterproof sealing member or tape 50. Then, the open top end 41 of the lining sleeve is attached to the inner liner 20 and the upper 10 near the top ends thereof. Afterward, the bottom end of the upper 10 is lasted over the bottom side of the cup bottom 31, and the filler layer 70 is provided within the opening confined by the bottom end of the upper 10 below the cup bottom 31. Finally, the outsole 60 is attached to the bottom end of the upper 10.

The shoe described hereinbefore provides the following advantages:

1. Except the top and bottom ends 41 and 42 which are attached to the upper 10 and the cup member 30, all part of the lining sleeve 40 is in a loose state which is free of adhesive or any other attachment means. As such, the lining sleeve 40 can provide a good breathing effect.

2. Since the bottom end 42 of the lining sleeve 40 is connected to the cup member 30, the lining sleeve 40 need not extend to the bottom end of the upper 10. This alleviates the risk of damaging the lining sleeve 40 due to the mechanical stress produced at the bottom of the upper 10 by the bottom of the wearer's foot, or the forces induced during the lasting process of the upper.

3. Since the lining sleeve 40 does not extend to the bottom end of the upper 10, the amount of the waterproof breathable material needed to fabricate the waterproof breathable lining sleeve 40 can be reduced and the cost thereof can be kept to a minimum.

4. Because the cup member 30 may be fabricated from a material having a degree of stiffness, the cup member 30 can be used as an insole for lasting the bottom end of the upper 10. This facilitates the process of making the shoe and reduces the cost of production.

5. Since the cup member 30 may be a molded body which can be formed into a shape in conformity with that of a last, the cup member 30 will not produce any excess material which need to be trimmed and removed during a lasting process, thereby simplifying the production and reducing the cost thereof.

Figure 7:
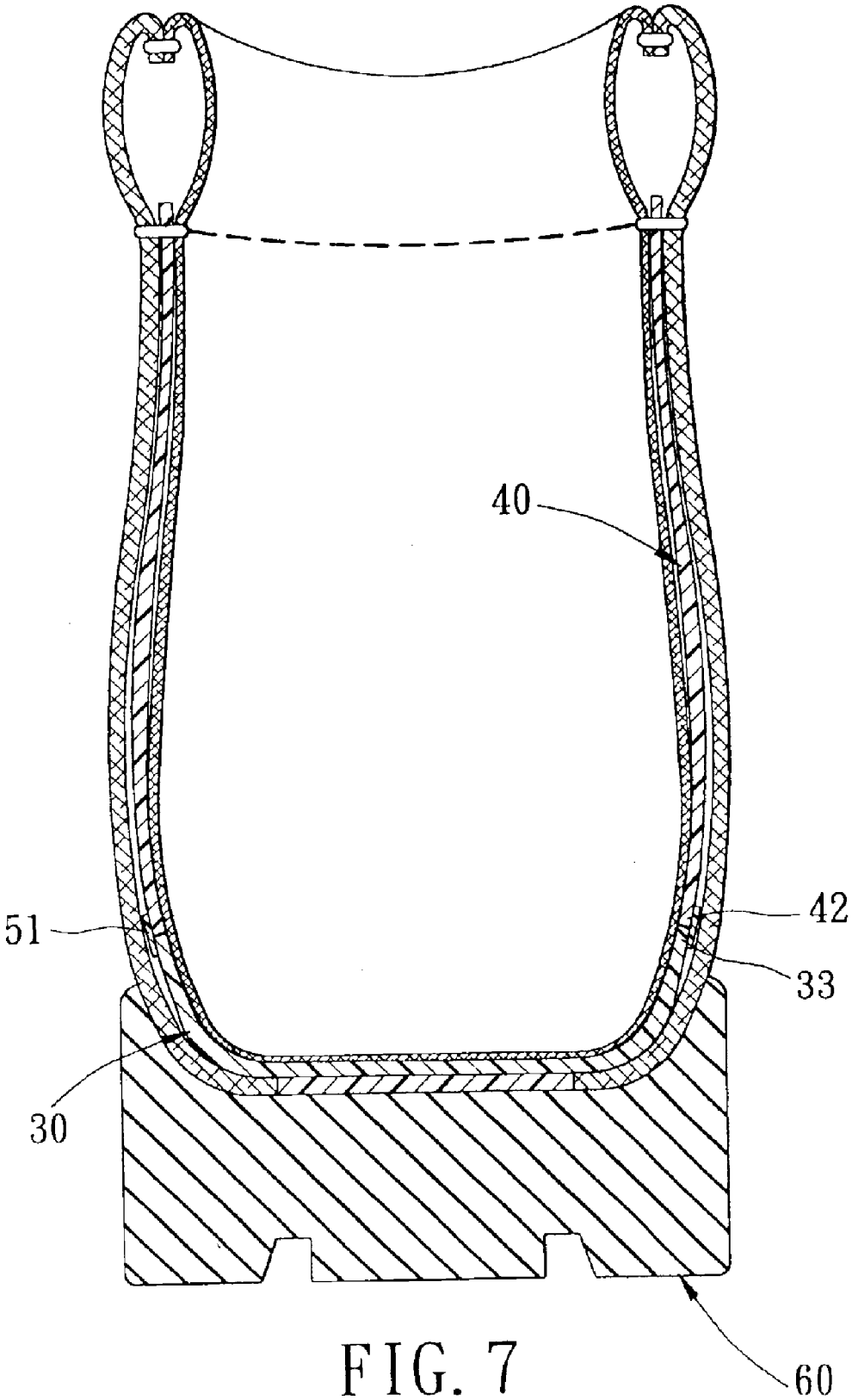
FIG. 7 is a sectional view of a second preferred embodiment.

FIG. 7 shows the second embodiment of a waterproof breathable shoe according to the present invention, which is substantially similar to the first embodiment except that the bottom end 42 of the lining sleeve 40 in this embodiment is sewn to the top end 33 of the cup member 30 via a zigzagged stitching pattern (not shown), and that a waterproof sealing tape 51 is attached to the seam between the lining sleeve 40 and the cup member 30.

Figure 8:
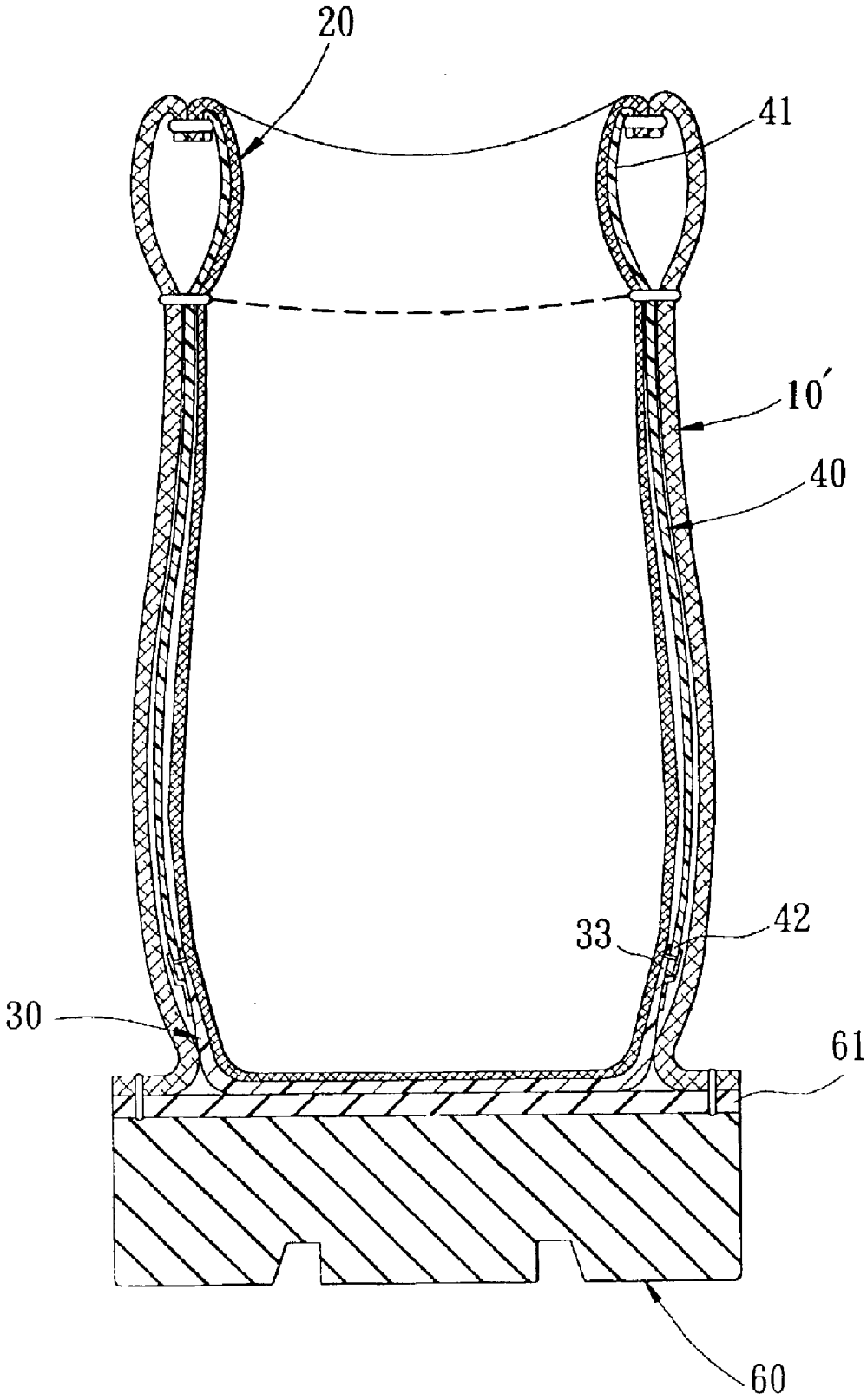
FIG. 8 is a sectional view of a third preferred embodiment.

FIG. 8 shows the third embodiment of the present invention which is substantially similar to the first embodiment except that the third embodiment is directed to a stitchdown shoe in which the upper 10' has a bottom end which is turned outward and stitched to a sole component 61.

Figure 9:
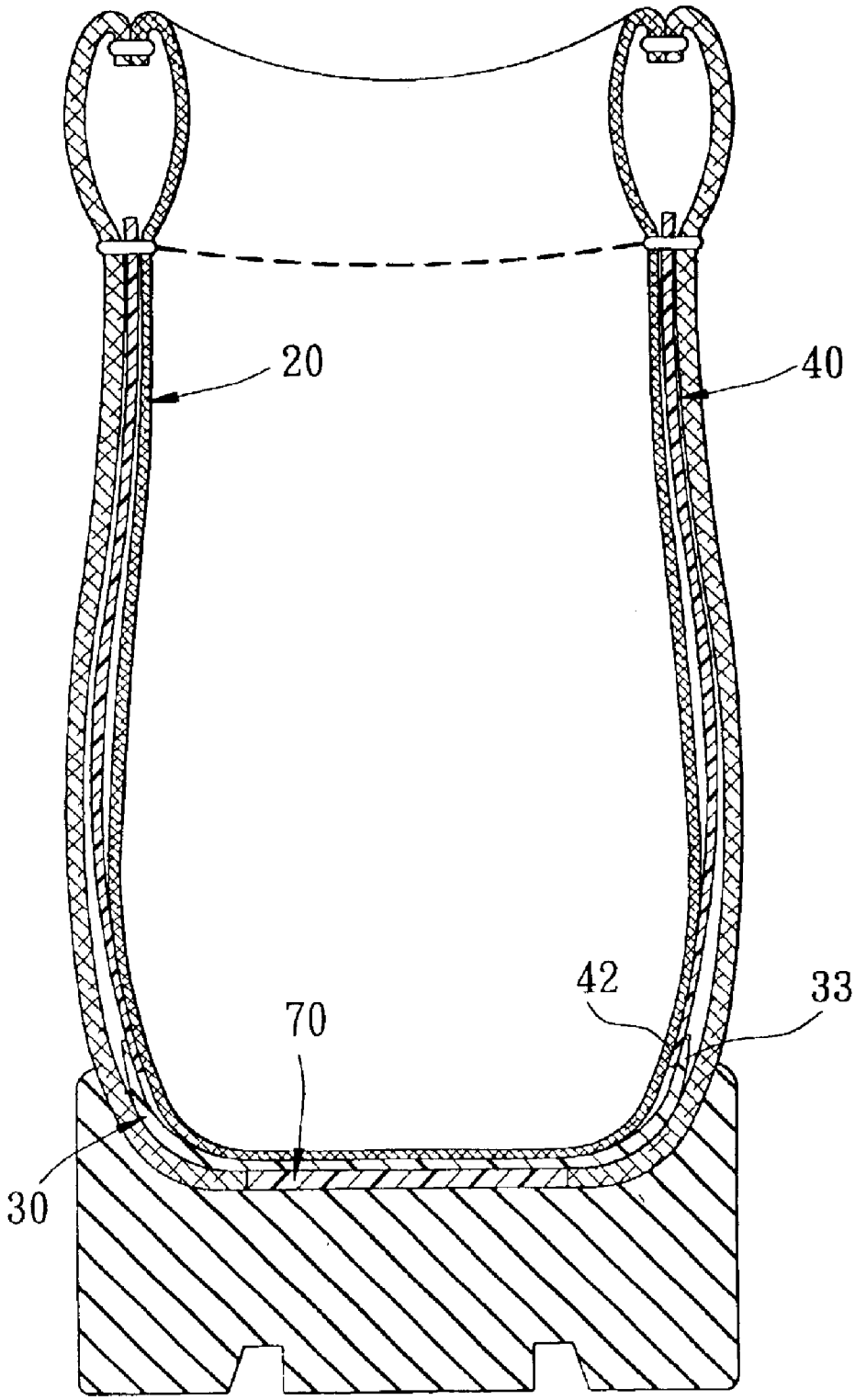
FIG. 9 is a sectional view of a fourth preferred embodiment.

FIG. 9 shows the fourth embodiment of the present invention which is substantially similar to the first embodiment except that the bottom end 42 of the lining sleeve 40 in the fourth embodiment is not only adhered to the outer surface of the inner liner 20, but also bonded to the cup wall 32 of the cup member 30. No waterproof sealing member is used in this embodiment.

Figure 10:
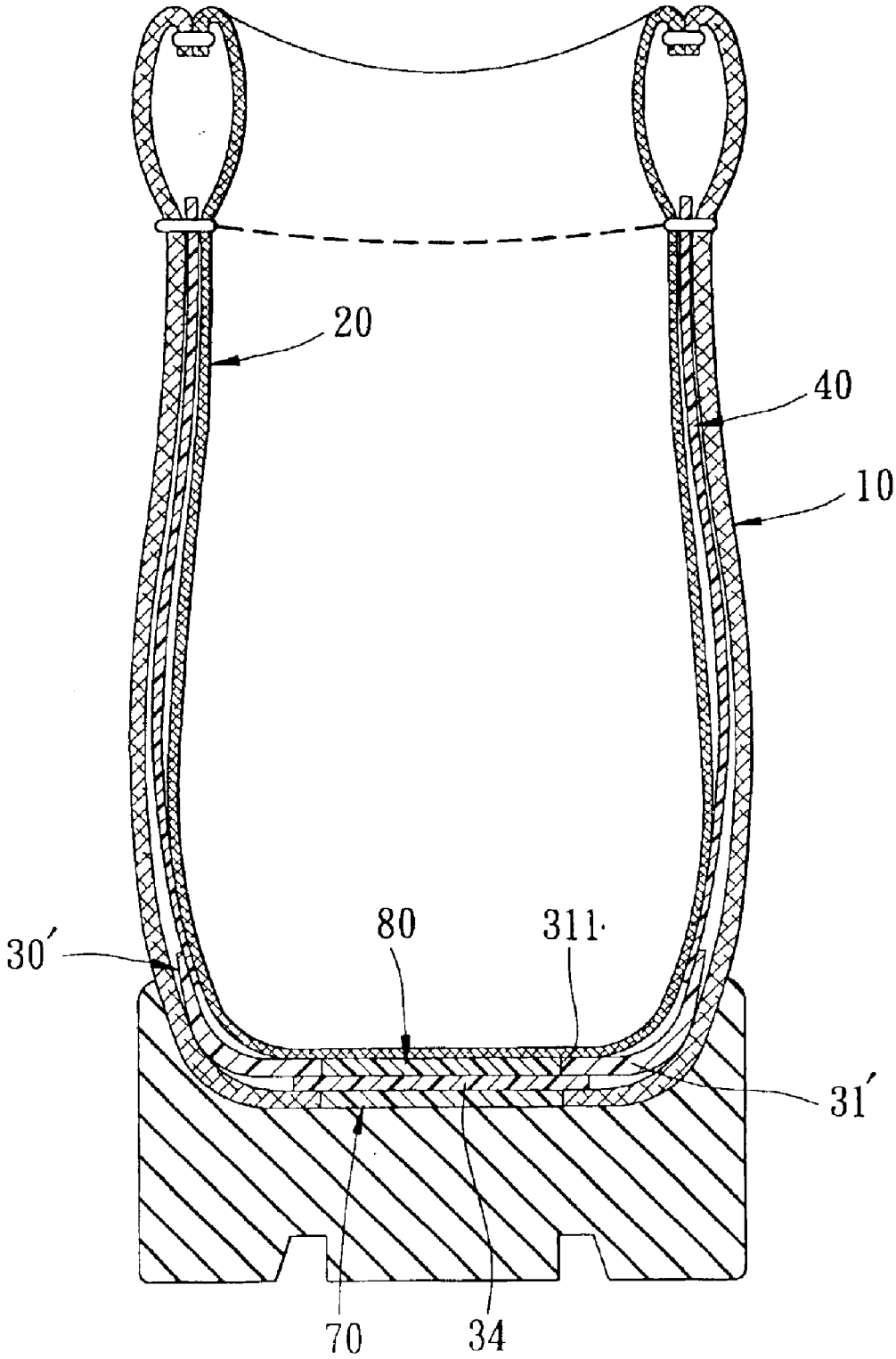
FIG. 10 is a sectional view of a fifth preferred embodiment.

FIG. 10 shows the fifth embodiment of the present invention which is substantially similar to the fourth embodiment except the differences described hereinbelow. In the fifth embodiment, a cup member 30' differs from the cup member 30 in that the cup bottom 31' of the cup member 30' is perforated to form an opening 311. The opening 311 is blocked by first and second sole elements 80 and 34. The first sole element 80 is fitted within the opening 311, and the second element 34 disposed below the first sole element 80 and adhered to the bottom side of the cup bottom 31' and the bottom side of the first sole element 80.

Figure 11:
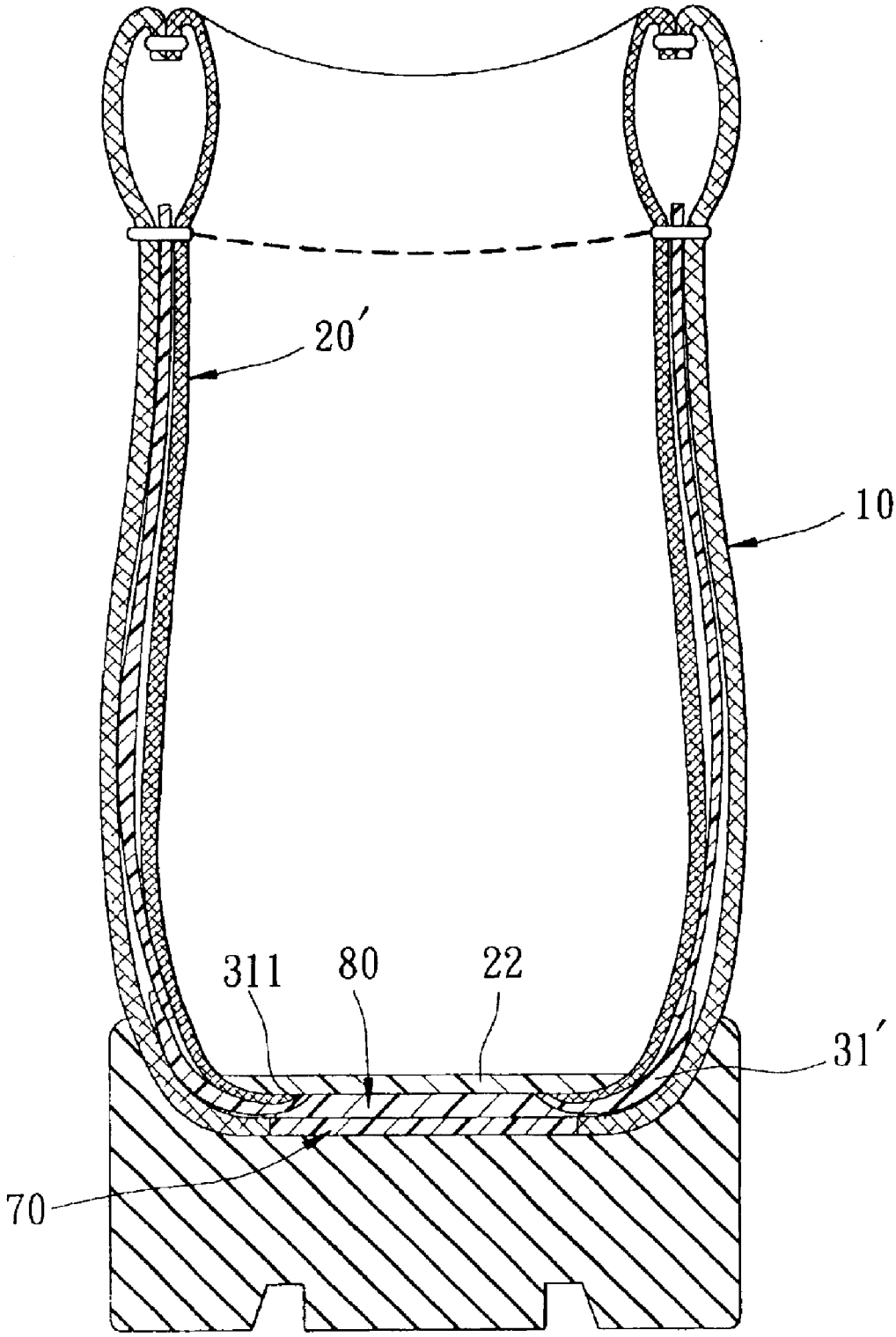
FIG. 11 is a sectional view of a sixth preferred embodiment.

FIG. 11 shows the sixth embodiment of the present invention which is substantially similar to the fifth embodiment except that the inner liner 20' in the sixth embodiment is open at its bottom and incorporates an insole 22 which blocks the open bottom of the inner liner 20'. The perforated cup bottom 31' is adhered to the bottom side of the inner liner 20' and the bottom side of the insole 22. The first sole element 80 is fitted within the opening 311 of the cup bottom 31' and within the open bottom of the inner liner 20'. The first sole element is adhered to the insole 22 and the filler 70.

Figure 12:
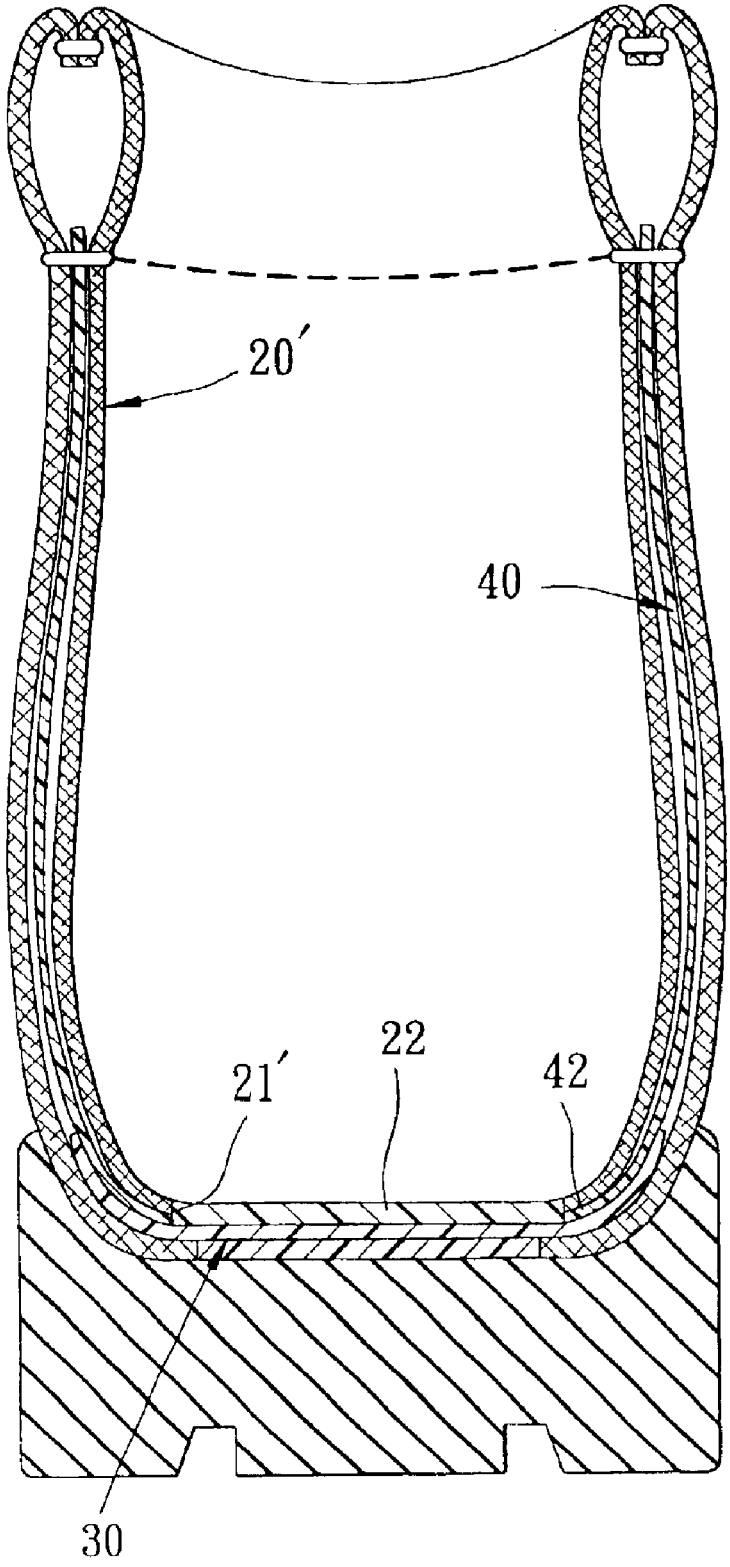
FIG. 12 is a sectional view of a seventh preferred embodiment.

FIG. 12 shows a seventh embodiment of the present invention which is substantially similar to the first embodiment except that the inner liner 20' incorporates an insole 22 fitted in an opening 21' at the bottom of the inner liner 20'. The bottom end of the lining sleeve 40 extends to the insole 22.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A waterproof shoe comprising:

an upper having an open bottom end;

a waterproof breathable lining sleeve mounted inside said upper and having a top end and an open bottom end, said lining sleeve being made of an air-permeable waterproof material; and a molded cup member made of an air-impermeable waterproof material and including a preformed cup bottom which has a toe region and a heel region connected to said toe region, and a preformed cup wall which projects laterally and upwardly from said cup bottom and extends around said toe region and said heel region, wherein said open bottom end of said lining sleeve is attached to said cup wall, and wherein said open bottom end of said upper is lasted over a bottom side of said cup bottom.

2. The waterproof shoe as claimed in claim 1, wherein said cup bottom is a closed bottom.

3. The waterproof shoe as claimed in claim 2, wherein said cup bottom further has a sole element which blocks said opening of said cup bottom.

4. The waterproof shoe as claimed in claim 1, wherein said cup bottom has an opening.

* * * * *